US005343742A

United States Patent [19]

Cusanelli et al.

[11] Patent Number: 5,343,742

[45] Date of Patent: Sep. 6, 1994

[54] FLOATING PLATFORM TOW POST

[75] Inventors: Dominic S. Cusanelli, Frederick, Md.; Jeffrey A. Bradel, Centreville, Va.

[73] Assignee: The United States of America as represented by the Secretary of the Navy, Washington, D.C.

[21] Appl. No.: 127,618

[22] Filed: Sep. 28, 1993

[51] Int. Cl.[5] ..... B63B 9/08

[52] U.S. Cl. ..... 73/145; 73/170.15

[58] Field of Search ..... 73/148, 147, 170.07, 73/170.08, 170.11, 170.15

[56] References Cited

U.S. PATENT DOCUMENTS

| | | | |
|---|---|---|---|
| 2,633,746 | 4/1953 | Miller | 73/170.07 |
| 3,052,120 | 9/1962 | Goodman et al. | 73/148 |
| 3,916,813 | 11/1975 | Stahl | 73/148 |
| 4,532,801 | 8/1985 | Coder et al. | 73/147 |

*Primary Examiner*—Donald Woodiel
*Attorney, Agent, or Firm*—Howard Kaiser

[57] ABSTRACT

A towing post provides a floating transducer platform on a carriage which is arranged for motion in a vertical direction above the center of pressure of a model being tested, for example, by towing across or through a towing basin. Linear bearings are attached to a carriage and engage vertical tracks extending between top and bottom fixed plates of the towing post. One or more transducers may be attached, one above the other, between the floating platform and the model and thus extend through an aperture in the lower plate. Attachment to the model through a gimbal located at the center of pressure of the model allows separation of a measurement, such as of drag, from effects of position and, if desired, a wide range of motion through one or more degrees of freedom, such as pitch and roll. Effects of towing post effects on trim are also eliminated and improved restraint of other motions is achieved. By accommodating more than one force transducer additional measurements can be made for calibration and/or adjustment which, for example, allow effects of yaw to be completely separated from drag measurements.

20 Claims, 4 Drawing Sheets

FLOATING PLATFORM TOW POST

STATEMENT OF GOVERNMENT INTEREST

The invention described herein may be manufactured and used by or for the Government of the United States of America for governmental purposes without the payment of any royalties thereon or therefor.

DESCRIPTION

BACKGROUND OF THE INVENTION

1. Field of the Invention

The present invention generally relates to the design of water-borne vessels and simulation of performance by model testing and, more particularly, to towing posts for measurement of forces on models under simulated operating conditions in towing basins.

2. Description of the Prior Art

Hull designs for water-borne vessels including surface ships and submarines is a highly complex process with substantial economic consequences. Given the extended useful lifetime generally characteristic of such vessels, a small loss of performance efficiency, such as a small increase in power required to maintain operation at a desired design speed, may translate into hundreds of thousands of dollars in fuel costs. Further, increased power requirements for certain desired performance may require larger power plants of increased weight which reduce the potential performance of the vessel. The cost of building vessels of even moderate size also dictates that the highest degree of certainty of performance predictions and efficiency must be obtained concerning the design before construction is begun.

Therefore, it has become customary to simulate the performance of vessel designs by model testing in towing basins in which models may be towed at various speeds scaled to desired operating conditions and in which wave action may also be accurately simulated. In such towing basins, movement of the model is achieved by attachment of the model (ideally at its center of pressure) to a carriage which traverses the basin. This attachment is generally designed to ideally allow only a few degrees of freedom to the model, such as roll, pitch and heave, so that the attitude of the vessel may be otherwise maintained in accordance with the desired test conditions. For example, in a drag test, the model should not be allowed to yaw since yaw will greatly increase values of drag for a very small angular displacement (often only a fraction of a degree) of the hull to the direction of motion.

The term "center of pressure", as used in this description of the invention as well as previous towing arrangements, is a location directly above the static center of buoyancy of the hull by a distance known as the metacentric height. That is, The "center of pressure" is at a location about which pitch and roll should occur. This usage is somewhat different from the other usages of the term, particularly in regard to the stability of sailing craft or the dynamic center of pressure of water on a hull due to planing or wave conditions. However, dynamic variation of the instantaneous center of pressure from the location defined above generally results in motions of the hull (e.g. pitch and roll or heaving) which are permitted and can be accounted for in the drag measurement. For example, changes in drag due to attitude (e.g. bow rise) as a planing hull changes from displacement mode to planing mode as speed increases is a measurement of interest in drag tests. Therefore, defining the "center of pressure" as being a metacentric height above the static center of buoyancy does not introduce errors into drag tests and, in some cases, avoids masking of information of interest in drag tests.

Other performance characteristics of the hull design, such as tendency to roll, yaw and pitch, can be evaluated by appropriate instrumentation or observation. Heaving (vertical translation of the center of pressure of the hull), surging (axial variation in speed of the center of pressure) and sway (lateral displacement of the center of pressure) under simulated sea and operational conditions may also be observed and/or measured. However, for the economic reasons mentioned above, drag testing remains one of the most common tests performed and the type of test which requires a great degree of accuracy, particularly with the recent increased interest in development of planing hulls.

While the general effectiveness of model testing in towing basins has been well-accepted for many years, several unavoidable sources of error have been inherent in towing arrangements which have been in use prior to this invention. The errors are particularly deleterious for drag testing but cause errors in other types of testing as well.

Specifically, the towing carriage should not provide a clearance above the water surface which is significantly greater than is required to accommodate heave of the model because the towing post is essentially a cantilever structure which must not deflect under towing loads. Otherwise, the geometry of the test set-up and the orientation of force sensors may be compromised. The towing post must also accommodate heaving of the model while carrying potentially large loads without placing detectable loads on the model. For this reason, rotary bearings have generally been used at either end of a towing arm, one end of which is attached to the model through a gimbal and the other attached to the towing post located forward of the gimbal attachment.

This arrangement inherently compromises the geometry of the test since heaving of the model would cause an angular change of up to twenty degrees in some cases in the coupling provided by the towing arm. In a drag test, this angular change also changes the angle of the force vector being measured and thus modulates the drag force. Further, due to the inability of a towing arm to restrain yaw, it was customary in the past to attach the towing arm to a point near the bow of the model rather than at the center of pressure. Therefore, the drag measurement was also modulated by pitching of the model. Additionally, increase in size of models has also increased the need to move the attachment point closer to the bow.

Any yawing of the model would also modulate the drag force measurement by the same mechanism as well as causing measurement of drag at the yaw angle rather than with the model held in correct trim. By the same token, since the prior towing arm allowed neither restraint of yaw nor measurements free from the effects thereof, adjustment of model yaw could not be accurately achieved. Since exact symmetry of models is not achievable and, in any event, ideal symmetry may not accurately characterize the hull shape of a constructed vessel, correct yaw cannot be established by merely aligning nominal model centerline with towing motion. Other effects may also inherently disturb drag measurements or trim of the model or both.

Planing hulls, in particular, have posed problems which have proved intractable with prior towing arrangements. In particular, planing hulls are operated at high speed and drag forces may be encountered which are far higher than for displacement hulls. More importantly, however, displacement hulls tend to sink slightly with increases in speed since negative lift is developed by the hull bottom. In contrast, planing hulls, by definition, provide positive lift through planing and the vertical movement of the hull due to this lift is many times the amount of vertical displacement usually observed with displacement hulls and accounts for the improvement of efficiency, at planing speeds, of planing hulls.

Yet another effect, although generally small, is that of inertial forces of the towing arm on the model during angular change. As the model pitches or heaves, the inertia due to any motion of towing structure not located at the center of pressure of the model will be reflected in a change of fore-and-aft trim of the model which will also modulate the drag force measured, perhaps in a highly unpredictable fashion.

Thus it is seen that the prior towing arrangements for model testing in towing basins included many inherent sources of error, particularly for critical drag measurements. At the present degree of refinement of hull design and the cost of construction of large vessels and fuel to power such vessels during their useful lifetime, the data provided by towing tests conducted in accordance with prior towing arrangements is of relatively reduced value because of the inaccuracy inherent in the previous towing structures. Despite the inherent inaccuracies, however, no towing arrangement offering more than a marginal accuracy improvement has been proposed.

SUMMARY OF THE INVENTION

It is therefore an object of the present invention to provide a towing post arrangement which allows for measurement of side forces and adjustment of yaw to substantially eliminate side forces.

It is another object of the present invention to provide a towing post arrangement which allows full restraint of yaw of a towed model.

It is a further object of the invention to provide a towing post arrangement which does not alter fore-and-aft trim of the model during pitching and heaving.

It is yet another object of the invention to provide a towing post arrangement which allows a true measurement of drag forces and of a geometry which cannot be compromised by model motion.

In order to accomplish these and other objects of the invention, an apparatus is provided for attaching a model to a test apparatus, including a carriage, a plurality of linear bearings attached to the carriage and arranged to provide a path of vertical motion of the carriage, at least one force transducer attached to the carriage, and a bearing, aligned with the path of travel of the carriage, for attaching the force transducer to the model.

In accordance with another aspect of the invention, a towing post for towing a model of a water-borne vessel through a towing basin is provided, including a frame having two plates held in a spaced relationship by a support means, a plurality of parallel rods extending between the two plates of the frame, a plurality of linear bearings, each of the parallel rods carrying a linear bearing, a carriage member carried by said linear bearings having a platform for mounting at least one force transducer to be carried by the carriage member along a path defined by the parallel rods, and an aperture in one of the two plates of the frame which is sized to provide a clearance around the force transducer when the force transducer is carried by the carriage along the path defined by the parallel rods.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
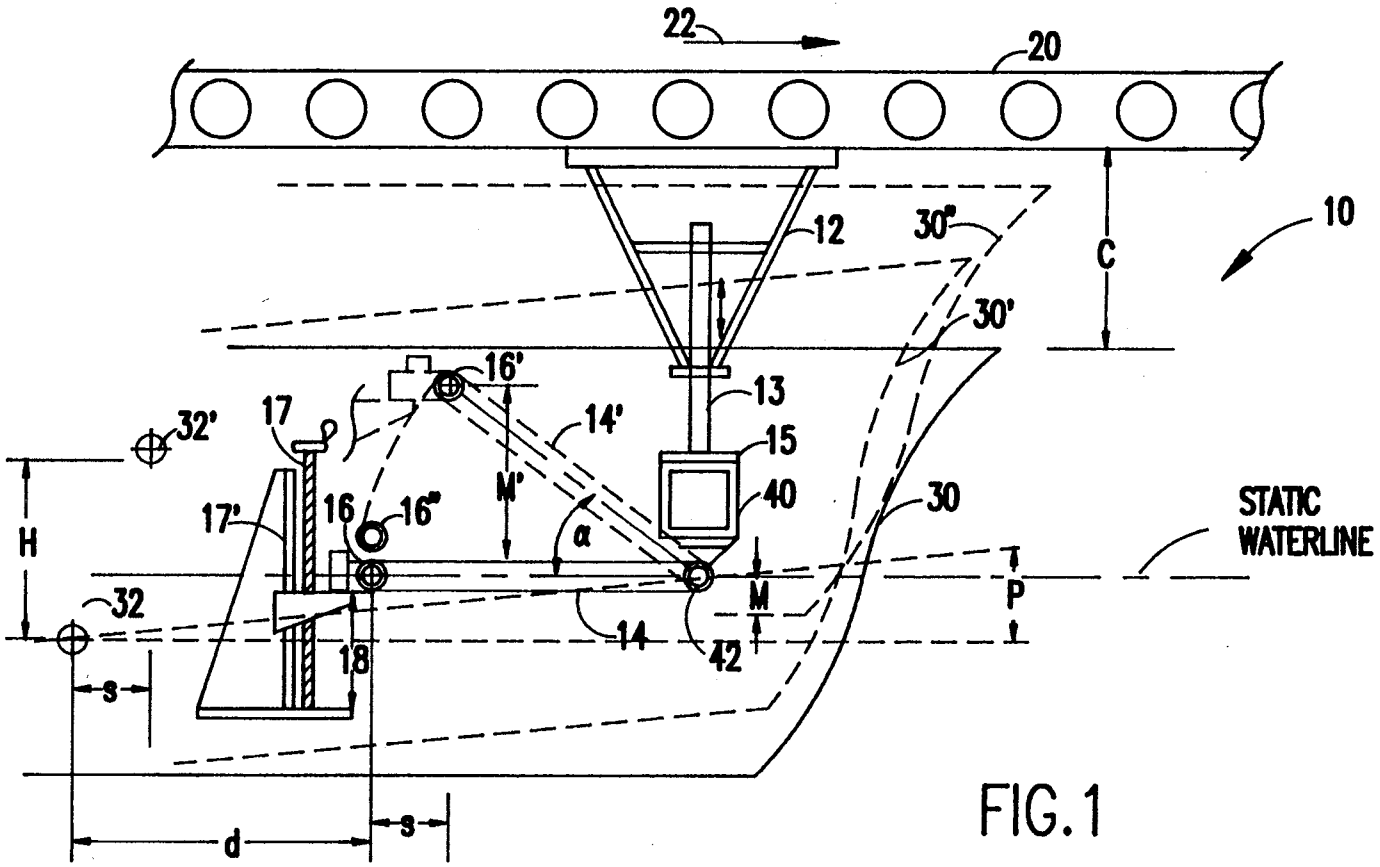
FIG. 1 is a schematic illustration of a previous towing arrangement as attached to a model.

Referring now to the drawings, and more particularly to FIG. 1, there is schematically shown a towing post and arm arrangement 10 which was used prior to the present invention. The towing carriage generally includes a beam 20 extending precisely in the direction of movement of the towing carriage (e.g. the towing direction). A towing post 12 having a convenient vertical dimension and an adjustment 13 to allow alignment with a gimballed attachment to a model when at rest and located vertically as closely as possible to the design static waterline was generally affixed to beam 20 by clamping or bolting. The lower end of the towing post 12 thus formed a platform 15 to which one side of a force transducer or load cell 40 for measuring drag forces was attached. A pivoting or rotational bearing 42 was provided at the other side of the load cell for attachment to the towing arm 14. Strain gauges affixed to the load cell 40, as will be discussed below, could thus measure the forces conducted from the towing arm 14 through the load cell to the towing post 12.

The connection of towing arm 14 to the model 30 was done with a gimbal 16 having two degrees of freedom to allow for heave, pitch and roll of the model. The single degree of freedom of rotational bearing 42 and the two degrees of freedom of gimbal 16 attempted to restrain the model against yaw. However, side forces could be transmitted to the load cell and thus disturb the drag force measurement if the model was not aligned with the towing direction by increasing drag due to yaw. Further, any sideways flexure in the towing arm would add an angular component to the drag force vector and modulate the measurement as mentioned above.

While useful data could be derived from this arrangement, the inherent sources of measurement error are evident when the allowed motion of the model 30 is considered as depicted by dashed outline 30' or 30'' which represents pitch P about center of pressure 32 and heave H (as referred to the change in position of center of pressure of the model from 32 to 32'), respectively. Most obvious, heaving of the model, particularly if it is a planing hull design, causes the vertical displacement of gimbal 16 to location 16' which, in turn causes an angular displacement $\alpha$ of towing arm 14 to location 14' which modulates the drag force. In the prior towing arm arrangement, the vertical location of gimbal 16 could be changed by means of a screw drive 17 along a vertical track 17' when the angle of the towing arm 14 became excessive or appeared to affect model trim. However, this adjustment necessarily disturbed the constancy of test conditions.

Additionally the fixed length of towing arm 14 causes a change in the horizontal location of gimbal 16 at 16' which, in turn, translates into a change in horizontal position of the center of pressure 32', simulating (or masking) surge, S, of the model (increased by the length of cantilever 18 modified by the angle of roll of the model, not shown). Since surge is an inertial force acting in the same direction as drag force, it is superimposed thereon at the load cell 40.

Further, gimbal 16 is ideally located on track 17 forming a cantilever 18 vertically above the center of pressure by moment M to provide clearance C which may be reduced as shown during pitching and heaving of the model. (This cantilever 18 must also be substantially free from flexure and the weight of material required to develop adequate strength may also be difficult to compensate in obtaining fore-and-aft static trim of the model.) Therefore, both drag and surge (whether real or an incident of the towing arm motion) disturb the fore-and-aft trim of the model. Similarly, the horizontal displacement of the towing point gimbal 16 from the center of pressure disturbs the fore-and-aft trim as the model must lift one end of the towing arm 14 through angle $\alpha$ due to both weight and inertia of the towing arm.

During pitching about the center of pressure, the axial displacement of the towing point from the center of pressure causes pitch of the model to be similarly translated into an angular displacement of arm 14, with effects similar to heaving as gimbal 16 is moved to position 16''. While this motion appears small in FIG. 1, the superposition of these similar effects made test results difficult to interpret and often masked data or modulated it in unpredictable ways. Further, it should be noted at this point that pitching of the model is not necessarily as small as depicted. Large amounts of pitching motion, particularly in combination with heaving motion, could not be accommodated beneath beam 20 and a different test set-up, cantilevered in front of the towing carriage, was employed, adding yet another set of sources of error between test runs and requiring a substantial amount of time and effort to change.

Therefore, without consideration of the further complications introduced by side forces and yaw of the model, it can be seen that the prior towing arrangement is a very complex dynamic system having numerous sources of error for a measurement of drag forces. The further complications introduced by side forces and yaw may be better understood from consideration of a load cell 40, shown somewhat enlarged and in isometric view in FIG. 1A.

Figure 1B:
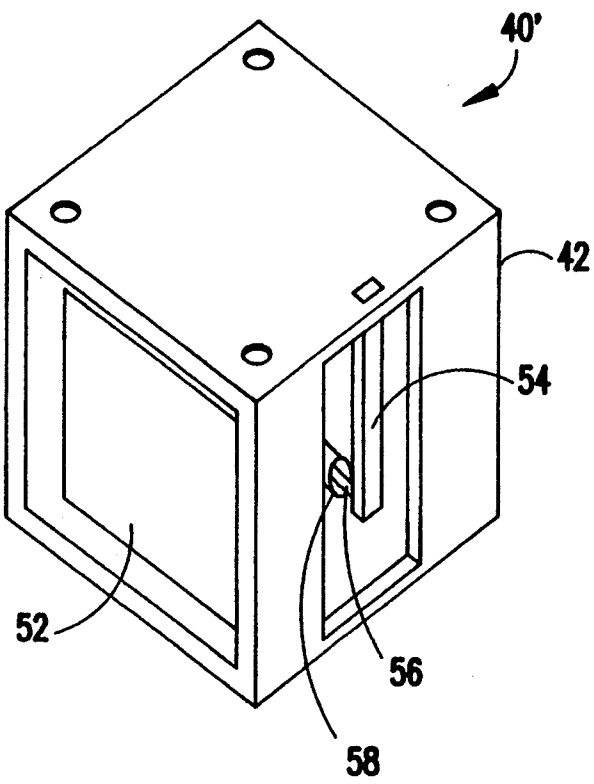
FIG. 1B is a partially cut-away view similar to an isometric view of a magnetic load cell of increased accuracy which can be used with the present invention.
Figure 1A:
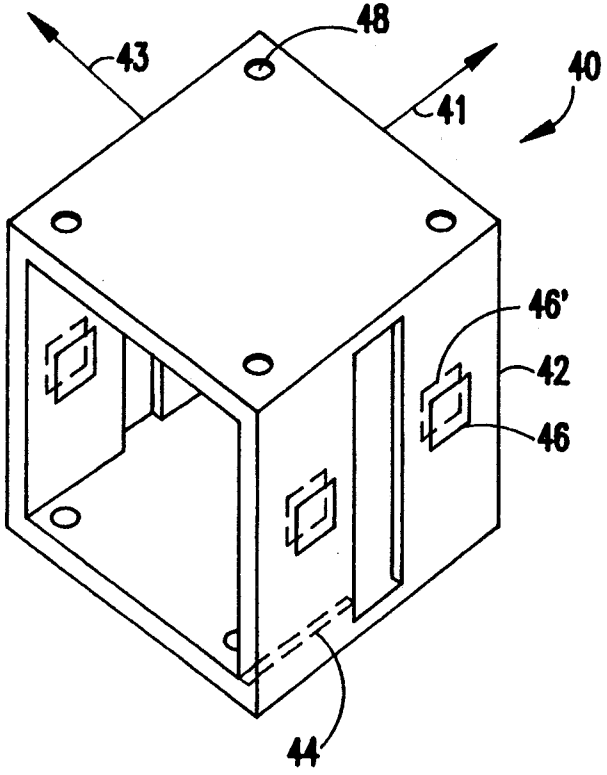
FIG. 1A is a view similar to an isometric view of a load cell used with the prior towing arrangement as well as the present invention.

Load cell 40, shown in FIG. 1A is essentially a cube of metal, such as steel, generally of four inches on a side, by convention, from which the interior is machined away, leaving a planar top and bottom connected by four legs 42. The load cell may be attached to other hardware by means of bolts placed through holes 48. The interior is machined away in such a manner that the legs 42 have a rectangular cross-section of relatively high aspect ratio as shown by dashed rectangle 44. When the top and bottom of the load cell are placed in shear, therefore, the load cell will be substantially stiffer in the direction indicated by arrow 41 than in the direction indicated by arrow 43. Thus, strain gauges 46 placed on the wide sides of legs 42 of load cell 40 can measure slight flexure of the legs in direction 43 while the load cell is capable of bearing a substantial load with little or no significant flexure in direction 41.

It is also common practice to apply strain gauges to both sides of each leg and to detect strain differentially. Such a practice permits calibration for such moments as M' of FIG. 1 which causes compression in differing degrees in each pair of legs 42 of load cell 40 to be placed in tension and the other two to be placed in compression and which measurements by the strain gauges are superimposed on the measurement of shear force across load cell 40.

Due to the rigidity of the load cell in direction 41, side forces cannot be directly measured. Recalling that yaw is a rotational force and that both yaw and side forces are applied to the load cell through a moment provided by towing arm 14 and appear at the load cell as a torsional force, the contributions of yaw and side force cannot be separated even if the sideways component could be measured at load cell 40. The remaining force is a rotational force on the load cell which tend to twist the legs and thus cannot be accurately resolved by differential sensing even though they would tend to place the strain gauges in tension at a diagonal to the intended direction of sensing. That is, sensed strain would appear as a bias on all strain gauges and appear slightly greater in strain gauges on the exterior of the load cell than on the inside. These forces can thus be seen to enormously complicate efforts to measure forces in direction 43 while not providing any measurement by which corrective action can be taken.

Figure 2:
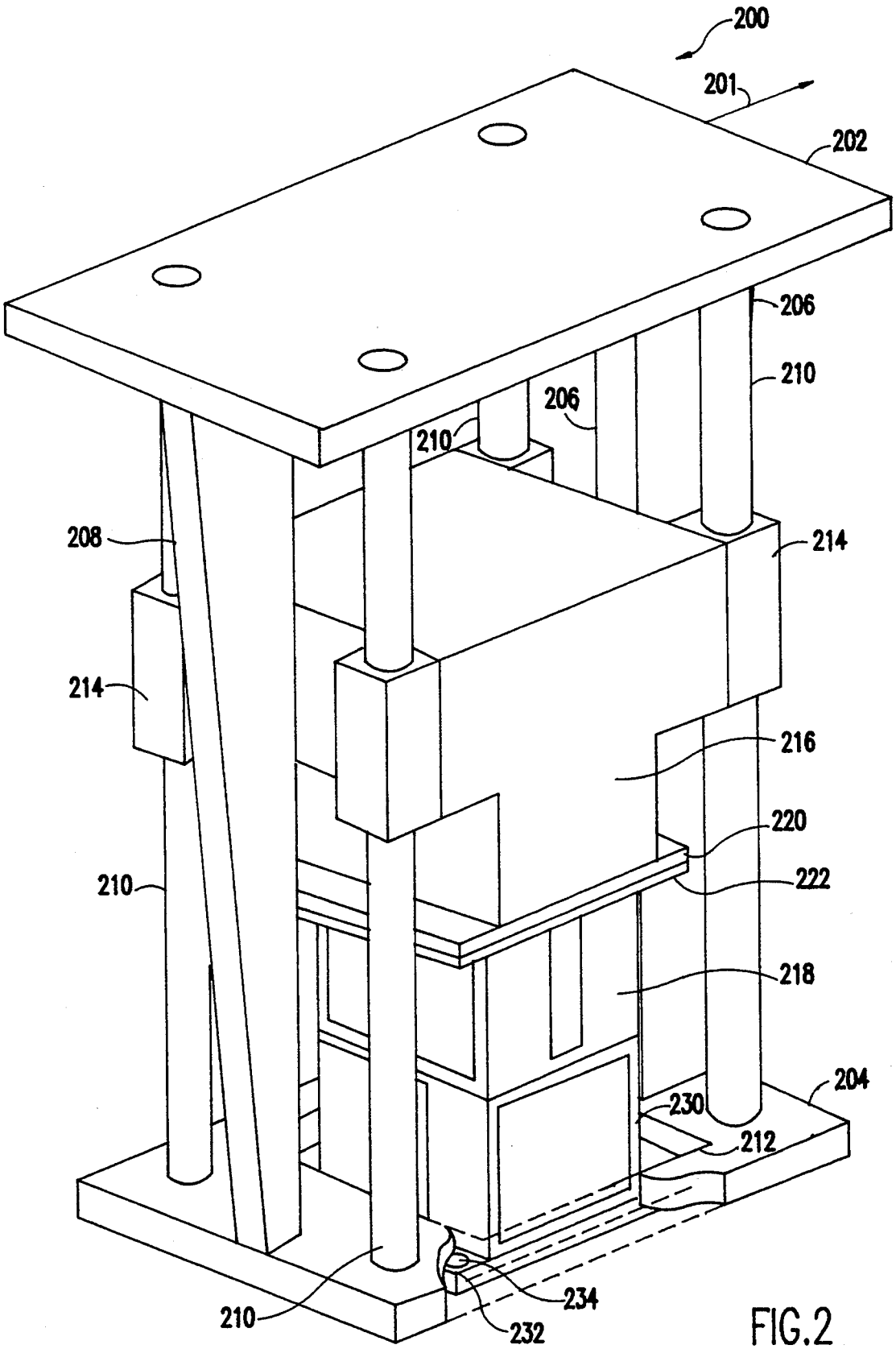
FIG. 2 is an illustration of salient features of the towing post in accordance with the principles of the invention from the viewpoint of an upper corner thereof.

Referring now to FIG. 2, the towing post 200 in accordance with the invention and which completely overcomes virtually all the above problems of the prior towing arrangement will now be explained. The only problem not directly addressed by the invention involves moments of force applied to the model due to towing post inertia in the case where the gimbal 16 attached to the model cannot be located at the center of pressure of the model when other equipment must be mounted at that location. However, since all other sources of error are effectively eliminated, no interactions between such sources of error can occur and correction of test data for this small effect is possible but seldom found to be required.

Since it is preferable to be able to retrofit the present invention to existing towing carriages used at existing towing basins, the top plate 202 and tapered cantilever supports 206, 208 are of generally the same dimensions and design as the prior towing post 12 of FIG. 1. The tapered braces can be more in number and the shape of the taper should be designed to provide negligible flexure for anticipated towing, side and yaw loads. For example, for maximum towing loads of five hundred pounds and side loads of one hundred fifty pounds, three-quarter inch sheet steel is more than adequate. It is also desirable to provide the tapered braces in the form of T-beams, for example, by welding a rectangular plate (omitted for clarity) to the vertical side of the tapered braces to increase lateral strength. The taper can be readily calculated as a cantilever to carry the anticipated towing load in the direction of arrow 201.

The towing post departs from the prior towing post structure at bottom plate 204 which, instead of forming a platform for providing a vertical adjustment for mounting a load cell, has an aperture 212 to provide a clearance around the load cells (e.g. 230). In accordance with the invention, the bottom plate 204 supports the lower ends of three or more (preferably four, as shown) parallel cylindrical rods 210, preferably fabricated from stainless steel, which are also supported by the top plate 202 to form a track for a carriage 216 and engaged by linear bearings 214 attached to carriage 216, preferably machined from a solid block of metal such as aluminum or steel. Bearings 214 are preferably of the recirculating roller type and are commercially available, together with the rods 210, from Thompson Industries, Inc. under part no. 2DA-16-KOA. Dust covers (not shown) are preferably provided around cylindrical rods 210 above and below the bearings 214. The diameter and number of the rods 210 and bearings 214 should be sufficient to have no significant collective flexure at the maximum design drag load of the towing post 200. This will generally be sufficient for restraining yaw of the model since yaw forces are generally limited to more than an order of magnitude less than drag loads. Side loads are also generally less than drag loads.

Carriage 216 thus forms a floating platform for load cell mounting which can rise and fall with pitching and heaving of the ship model. Specifically, carriage 216 is generally T-shaped to provide a mounting flange for one or more load cells which may be attached thereto by means of flange 222 by bolts or screws (not shown). The width of the towing post in accordance with the invention is also relatively narrow in a direction transverse to the direction of tow and thus can reach into the ship model to the center of pressure thereof. Thus, the weight of the floating carriage 216, including bearings 214 and load cells, is supported by the buoyancy of the model along the path of motion of the carriage 216 and can be fully compensated by reducing the amount of ballast which would otherwise be required to achieve the design waterline of the model when at rest. Alternatively, a counter balance arrangement to compensate for the weight of the carriage, bearings and load cells could be provided within the level of ordinary skill in view of this disclosure. In either case, this weight is maintained vertically positioned above the mounting point on the model (e.g. ideally, the center of pressure) and the load connected to the model through a gimbal so that the attitude of the model (e.g. in pitch or roll) has no effect on model trim.

As a practical matter, for powered models or where additional instrumentation is required, it may be necessary to mount motors or other instruments near the center of pressure, precluding attachment of the towing arrangement in the preferred location. In this case, the closest possible location ahead of the center of pressure is chosen. This causes the weight and inertia of the towing arm supported by the model to exert a force on the model tending to force the bow downward. While the weight of the towing arrangement can be approximately compensated by ballast, inertial effects cannot and cannot be separated from the other sources of disturbance of trim noted above. Nevertheless, in accordance with the invention, the weight of the carriage 216 together with load cells and hardware is accurately known, as is the distance of the mounting point from the center of pressure. Therefore, computation of trim changes due to inertial effects can be done, if desired, by a simple and straightforward computation from carriage movement in the vertical direction as a function of time to ascertain that the effects remain negligibly small. Such a computation would have been prohibitively difficult if not impossible in the prior towing arrangement due to the complexity of geometry and the interaction between different forms of model motion.

Another important feature of the floating platform in accordance with the invention is that sufficient height is provided to place two load cells 218, 230 one above the other below the floating platform formed by flange 220. That is, the total height of the carriage 216 and load cells 218, 230 should equal or slightly exceed the amount of travel provided by the rails and bearings of the distance between the lower surfaces of the top and bottom plates 202, 204. This additional capacity to accommodate additional load cells is preferably exploited by providing a load cell 218 oriented for measurement of side loads which permits measurement of and full compensation for yaw forces which may be due to model asymmetry, as will be discussed more fully in regard to FIG. 4. Since the side load cell 218 is highly rigid in the towing direction 201, the drag load cell 230 can be mounted directly below the side load cell 218. The towing post is completed by attachment of a gimbal to flange 232 which is fabricated with oversize holes 234.

Figure 3:
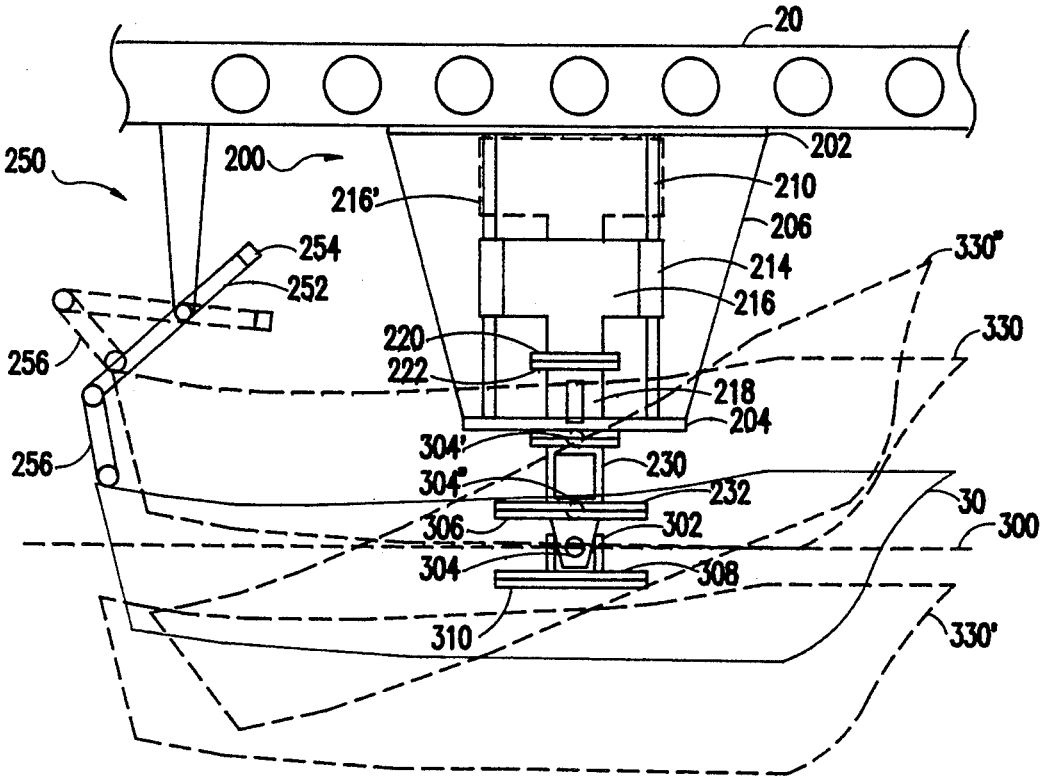
FIG. 3 is a side view of the towing post of the invention illustrating operation thereof.

Referring now to FIG. 3, which is a side view of the towing post of FIG. 2, the principal mode of operation of the invention will now be discussed. Reference numerals used in FIGS. 1 and 2 will be used in FIG. 3, insofar as possible. Towing post 200 can be mounted to towing carriage beam 20 in the same manner as prior towing arrangement 12 or in any other convenient manner since the mounting is unimportant to the practice of the invention, so long as the cylindrical rails 210 are precisely vertical. Shims may be used to achieve this alignment, if necessary. The lower end of the towing post 200 is attached to a mounting plate 310 of the model 30 shown at a rest position by solid lines and ballasted to achieve a design waterline as indicated at 300. The attachment is preferably made through a gimbal 302 having two degrees of freedom (pitch and roll) with the center of the gimbal located precisely at the center of pressure of the model. Spacers may be used between any pair of flanges (e.g. 220–222, 232–306 or between the load cells) to bring carriage 216 to the center of possible travel along rails 210 within the towing post 200. The support of the load cells 218, 230 and carriage 216 by the buoyancy of the model precisely at the center of pressure, referred to above, is particularly clear in this illustration.

Since the area occupied by the towing post 200 in a horizontal plane is small, the towing post may be allowed to protrude into the interior of the model and thus a large range of heaving pitching and rolling motion of the model may be allowed by virtue of the invention. For example, a heaving motion of the model which raises the center of pressure of the model to position 304', as depicted at 330, which may be caused by wave action, could raise the upper edge of the model hull above the lower plate 204 of the towing post 200 without causing mechanical interference between the model and the towing post. Similarly, lowering the model to position 330', as might be caused by a trough between waves, can be accommodated by the floating platform. Drag measurements are unaffected by the vertical position of the model by virtue of the floating platform in accordance with the invention.

Likewise, a wide range of pitching and rolling motion can be accommodated in combination with heaving motion. For example, wave action might raise the center of pressure to position 304" as well as causing an extreme pitching motion as indicated at 330". In this case also, drag measurement is unaffected since the towing arm is gimballed at the center of pressure of the model and the load cells have a fixed geometry in relation thereto which, in contrast with the prior towing arrangement, is completely unaffected by model attitude.

Figure 4:
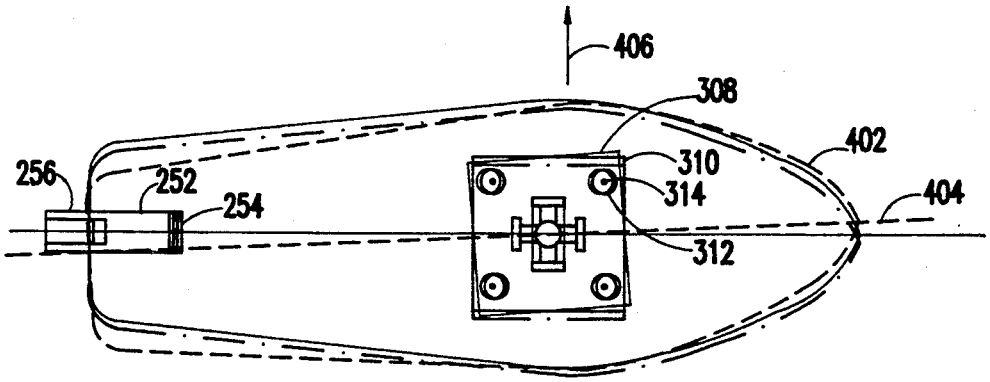
FIG. 4 is a top plan view of the attachment to a model of the towing post in accordance with the invention and illustrating lateral trim adjustment.

Referring now to FIG. 4, another important feature of the invention yielding a capability not available in prior towing arrangements will now be discussed. Specifically, the present invention allows complete and rigid restraint of yawing of the ship model. Therefore, during a towing run, tendency of the model to yaw in the attitude at which it is constrained resolves to a sideways force which is readily and directly measured by load cell 218. That is, any misalignment or asymmetry of the model hull, represented by dashed lines 402, 404 of FIG. 4, will develop sideways lift 406 during towing of the model.

As mentioned above, flange 232 positioned below the drag load cell 230 is fabricated with oversize holes 234. Likewise flange 308 and or mounting plate 310 can also be provided with oversize holes 312. Thus, the mounting of the model to the towing arm can be positionally adjusted where the flanges are secured together such as with bolts 314 which are of smaller diameter than the oversize holes 312.

When a towing run is conducted with the model nominally in correct alignment, sideways forces may be measured with high accuracy by load cell 218 which will indicate both a magnitude and direction of the force. If such a side load is detected, the positional mounting of the model to the towing post 200 may be adjusted (either laterally (chain line of FIG. 4) or rotationally (dashed line), usually by a very small fraction of an inch between, for example, flanges 308 and 310 in a direction to reduce the side force.

To assist in the accuracy of this adjustment, a simple mechanism 250, referred to as a "grasshopper" is preferably provided at the stern of the model. Pivoted from a post preferably clamped or bolted to beam 20, two pivoted arms 252 and 256 provide connection to the stern of the model to further restrain motion only in a lateral direction. A counter weight 256 is provided on arm 252 so that no weight is carried by the model. The grasshopper structure is very light in weight and inertial effects are very small and tend to balance inertial effects if gimbal 304 is mounted ahead of the center of pressure. Yaw trim adjustments are generally a small fraction of an inch over the extent of the model aft of the gimbal 304 which is often on the order of 20–30 feet. Adjustment is often so small that the mounting gimbal need not even be loosened for stress relief.

If a side force is detected after the adjustment is made, a highly precise further adjustment can be usually determined by interpolation or extrapolation based on the two measured levels of side force and the distance of the first adjustment. Therefore, precise directional trim can usually be achieved within a very few towing runs. Thus, the invention provides for an accuracy of directional trim which is entirely unavailable in prior towing arrangements. Further, the directional restraint of yaw provided by the invention is highly superior to that heretofore attained. Accordingly, the invention provides for measurement of drag with accuracy not previously possible since effects of yaw on drag can be completely eliminated or easily held to negligible levels.

As an example of the effectiveness of the invention to develop high accuracy drag measurements with little effect from yaw trim, a model was mounted on the towing post in accordance with the invention and yaw was adjusted by trial and error but without measurement of side forces to obtain minimum drag, as with the prior towing arrangement. A test run with the model in this trim resulted in a drag force of two hundred five pounds and a side force of eight pounds. After several further test runs for adjustment of trim in yaw based on measured side forces, the side forces were reduced to one and one-half pounds, resulting in a further reduction of measured drag to one hundred ninety-eight pounds. Based on this and other experience with the invention to date, it is considered that keeping side forces below one percent of drag forces yields significantly improved accuracy of drag measurements. Further, the guidance provided by measurement of both magnitude and direction of side forces allows this level of trim accuracy to be achieved far more easily and quickly than the trial and error procedure necessitated by the prior towing arrangement.

It should also be noted that further complex procedures such as propeller disk wake surveys (determining speed and direction of water flow in the propeller plane) to detect trim variation can be done, if necessary, from a much higher level of trim refinement by virtue of the invention. Therefore, the invention allows much reduction in the time required to determine the presence of any anomalies which may be encountered such as yaw trim varying with speed which may indicate excessive asymmetry in the model for reliable testing.

The load cells of FIG. 1A suffer from the problem of loss of adhesion between the strain gauges 46 and the body 42 of the load cell. Also, as mentioned above, differential sensing of strain is done in order to reject some components of force which may be detected by individual strain gauges. Since the invention provides for reducing all forces other than the drag force of interest to very low levels, a magnetic force transducer or load cell 40', such as that shown in FIG. 1B, can be used and is well suited to the invention because there is no need for differential sensing to resolve the force of interest. This load cell uses the identical structure for body 42 as in the load cell of FIG. 1A. However, this load cell detects very small displacements inductively by providing a stator coil 52 attached to one of the top or bottom surfaces of the body of the body 42 of the load cell. A rod 58, extending into an aperture 56 of the stator coil 52 is rigidly supported by the other of the top or bottom surfaces. Movement of rod 52, which may be a permanent magnet, alters the inductance of portions of the stator coil in a manner not otherwise important to the practice of the invention and develops very high sensitivity to such motion with a simple structure and without complex signal processing. This motion can then be referred to the dimensions of the legs of the load cell body 42 to determine the actual load applied to the load cell with a similarly high degree of precision.

Therefore, by reducing spurious forces which would be sensed and potentially rejected by signal processing using the load cells of FIG. 1A, a more sensitive force transducer may now be used with increased convenience for model testing.

In view of the foregoing, it is clearly seen that the invention provides an increased range of heaving, pitching and rolling motion of the model while providing an improved restraint of the model in yaw. Further, the invention provides for adjustment of the model attitude in yaw to eliminate the effects of yaw on drag. Motion of the model does not cause or simulate surging or cause any other modulation of the drag force measurement and the towing post in accordance with the invention eliminates any effect on model trim due to interaction between the geometry of the towing arrangement and model motion.

While the invention has been described in terms of a single preferred embodiment, those skilled in the art will recognize that the invention can be practiced with modification within the spirit and scope of the appended claims. For example, the invention is not limited to use in test apparatus for towing basins but could, in principle, be applied to other test apparatus such as wind tunnels in which the model would move only in a direction along a path of motion of carriage 216 which a fluid, such as air, was made to flow past the model. Likewise, a fluid current could be maintained in a towing basin while the model was towed across the basin for testing within the scope of the invention.

Having thus described my invention, what I claim as new and desire to secure by Letters Patent is as follows:

1. Apparatus for coupling a model with testing means, said testing means including force transducer means, said apparatus including a carriage, a housing for said carriage, said housing having an upper member, a lower member and a plurality of vertical tracks, each said vertical track joining said upper member and said lower member, a plurality of linear bearings attached to said carriage, each said linear bearing engaging one said vertical track, thereby providing vertical movability of said carriage, said lower member being configured so as to provide clearance for said vertical movability, means for attaching, so as to permit said vertical movability, said force transducer means to said model, and means for attaching, so as to permit said vertical movability, said force transducer means to said carriage.

2. Apparatus as recited in claim 1, wherein said means for attaching said force transducer means to said model includes a gimbal.

3. Apparatus as recited in claim 2, wherein said gimbal has two degrees of freedom.

4. Apparatus as recited in claim 3, wherein said two degrees of freedom are pitch and roll of said model.

5. Apparatus as recited in claim 4, wherein said carriage, said force transducer means and said means for attaching said force transducer means to said model are at least partially supported by said model.

6. Apparatus as recited in claim 4, wherein said testing means includes means for measuring side loads with respect to the relative motion of said model and fluid flow around said model.

7. Apparatus as recited in claim 4, wherein said testing means includes means for measuring drag loads with respect to the relative motion of said model and fluid flow around said model.

8. Apparatus as recited in claim 3, wherein said carriage, said force transducer means and said means for attaching said force transducer means to said model are at least partially supported by said model.

9. Apparatus as recited in claim 2, wherein said gimbal is located at a center of pressure of said model.

10. Apparatus as recited in claim 1, wherein said carriage, said force transducer means and said means for attaching said force transducer means to said model are at least partially supported by said model.

11. Apparatus as recited in claim 1, wherein said testing means includes means for measuring side loads with respect to the relative motion of said model and fluid flow around said model.

12. Apparatus as recited in claim 1, further including means for restraining an attitude of said model in at least one rotational direction.

13. Apparatus as recited in claim 12, wherein said at least one rotational direction includes yaw.

14. Apparatus as recited in claim 12, wherein said means for restraining an attitude of said model includes means for adjusting said attitude.

15. Apparatus as recited in claim 1, wherein said testing means includes means for measuring drag loads with respect to the relative motion of said model and fluid flow around said model.

16. A towing post for towing a model of a waterborne vessel through a towing basin including a frame having two plates held in a spaced relationship by a support means, a plurality of parallel rods extending between said two plates, a plurality of linear bearings, each of said parallel rods carrying a linear bearing, a carriage member carried by said linear bearings, said carriage member including a platform for mounting at least one force transducer means to be carried by said carriage member along a path defined by said parallel rods, and an aperture in one of said two plates, said aperture being sized to provide a clearance around said force transducer means when said force transducer means is carried by said carriage along said path defined by said parallel rods.

17. A towing post as recited in claim 16, further including said at least one force transducer means, including a force transducer means for sensing a force in a direction orthogonal to another force transducer means.

18. A towing post as recited in claim 17, wherein one said force transducer means is oriented to sense a side force on said model.

19. A towing post as recited in claim 18, further including means for attaching said at least one force transducer means to said model while providing at least one degree of freedom of rotational motion of said model and restraining an attitude of said model against at least one other direction of rotational motion of said model.

20. A towing post as recited in claim 19, wherein said means for attaching said at least one force transducer means to said model includes means for adjusting said attitude of said model in said at least one other direction of rotational motion.

* * * * *